United States Patent [19]

Takeyama et al.

[11] Patent Number: 4,483,528

[45] Date of Patent: Nov. 20, 1984

[54] PAPER SHEET FEEDING APPARATUS FOR COPYING MACHINE

[75] Inventors: Kokichi Takeyama; Kiyoshi Sugawara; Yasuyuki Fukagawa, all of Kanagawa, Japan

[73] Assignee: Fuji Xerox Co., Ltd., Tokyo, Japan

[21] Appl. No.: 317,733

[22] Filed: Nov. 3, 1981

[51] Int. Cl.[3] ..... B65H 7/08

[52] U.S. Cl. ..... 271/9; 271/110; 271/127

[58] Field of Search ..... 271/9, 117, 118, 110, 271/111, 126, 162, 127

[56] References Cited

U.S. PATENT DOCUMENTS

| | | | |
|---|---|---|---|
| 3,265,384 | 8/1966 | Shute | 271/118 X |
| 3,598,396 | 8/1971 | Andrews | 271/9 |
| 4,023,792 | 5/1977 | Punnett | 271/118 X |
| 4,204,668 | 5/1980 | Yanagawa | 271/9 |
| 4,299,380 | 11/1981 | Ogihara | 271/9 |
| 4,337,935 | 7/1982 | Sawada | 271/9 |
| 4,394,008 | 7/1983 | Sugiyama | 271/118 X |

*Primary Examiner*—Richard A. Schacher

*Attorney, Agent, or Firm*—Sughrue, Mion, Zinn, Macpeak, and Seas

[57] ABSTRACT

A manual paper sheet feeding device in a paper sheet feeding apparatus of a copying machine, which apparatus also has an automatic paper sheet feeding device, is provided with a detector for detecting the manual feeding of a paper sheet and the automatic paper sheet feeding device is provided with means responsive to an output from the detector for disengaging paper sheets from a feeding roll thereof.

1 Claim, 3 Drawing Figures

PAPER SHEET FEEDING APPARATUS FOR COPYING MACHINE

BACKGROUND OF THE INVENTION

The present invention relates to a paper sheet feeding apparatus for a copying device, which has a manual paper sheet feeding device and an automatic paper sheet feeding device.

A typical example of a conventional paper sheet feeding apparatus is shown schematically in FIG. 1. In FIG. 1, the automatic paper sheet feeding device comprises a feeding roll 1 and a paper sheet cassette 3. In operation, the roll 1 and a pair of registration rolls 2 are driven alternately, i.e., first the feeding roll 1 which contacts the uppermost paper sheet of the paper sheet stack 4 in the cassette 3 is driven to send the uppermost sheet to the registration rolls 2, and then the driving of the feeding roll 1 is stopped and the registration rolls 2 are driven to send the paper sheet to a transfer portion of a photosensitive drum 5 included in the copying machine.

The manual feeding device comprises a manual sending table 6 and a manual feeding roll 7. Paper sheets are sent one by one from the manual sending table 6 to the manual feeding rolls 7 through which the paper sheets are fed to the registration rolls 2. The sheets are then moved from the registration rolls 2 to the photosensitive drum 5 one by one with a suitable timing.

In the conventional apparatus such as shown in FIG. 1, since both the manual feeding rolls 7 and the automatic feeding rolls 1 are normally driven, the paper sheets 4 in the cassette 3 may be fed even when the manual paper sheet feeding device is in operation. In order to avoid this inconvenience, it has commonly been necessary to remove the cassette 3 from the copying machine when the manual operation is selected. This is very troublesome.

SUMMARY OF THE INVENTION

An object of the present invention is to provide a paper sheet feeding apparatus including both manual and automatic paper feeding devices in which there is no need to remove the paper sheet cassette of the automatic paper sheet feeding device from the paper sheet feeding apparatus when manual feeding is selected.

The above object can be achieved, according to the present invention, by constructing the paper sheet feeding apparatus such that, when a paper sheet is fed manually through the manual paper sheet feeding device, the paper sheets in the cassette of the automatic feeding device are pressed downwardly to thereby isolate them from the feeding roll.

DETAILED DESCRIPTION OF THE PREFERRED EMBODIMENTS

Figure 1:
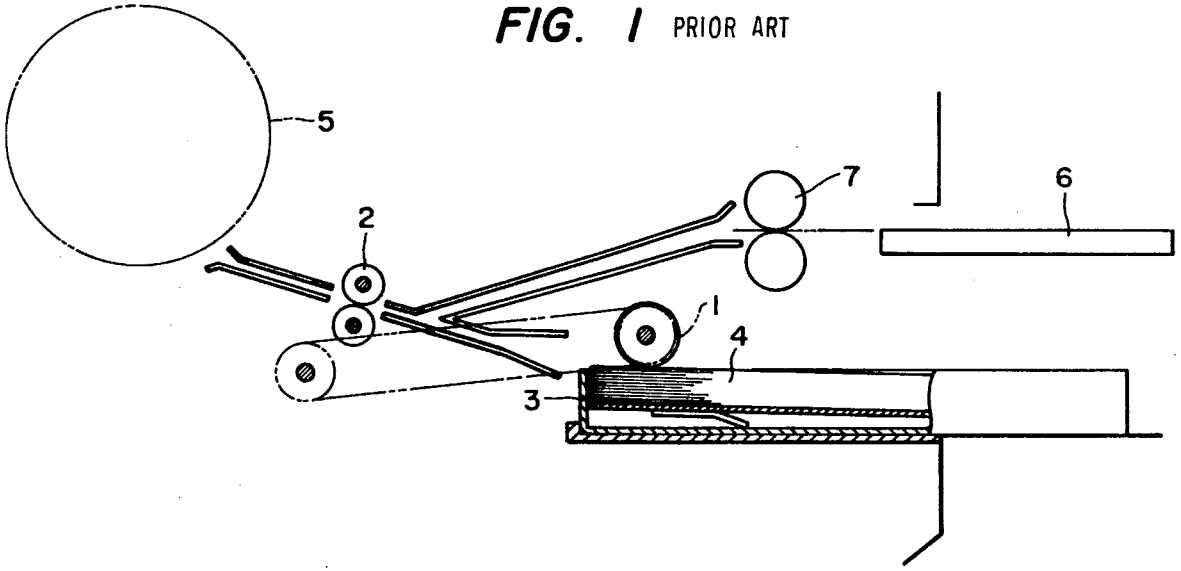
FIG. 1 PRIOR ART
FIG. 1 is a schematic cross sectional view of a conventional paper sheet feeding apparatus for a copying machine.
Figure 2:
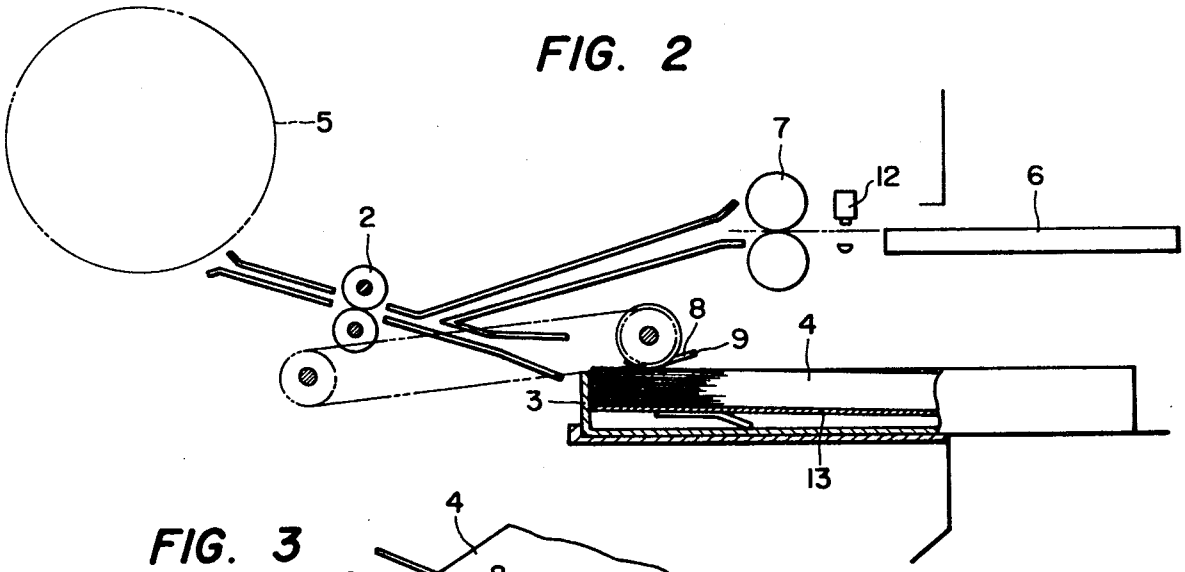
FIG. 2 is a schematic cross sectional view of the paper sheet feeding apparatus according to the present invention.
Figure 3:
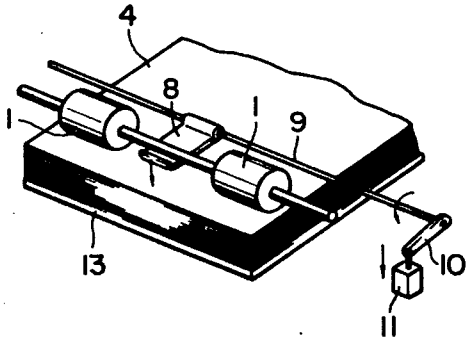
FIG. 3 is a perspective view of the main components of the paper feeding apparatus in FIG. 2.

In FIGS. 2 and 3, in which the same components as those in FIG. 1 are shown by the same reference numerals, a rotatable shaft member 9 is provided in parallel with and in the vicinity of a shaft supporting the feeding rolls 1. One end of a tongue member 8 is fixedly secured to the shaft member 9 so that the other end of the tongue member 8 is rotated with rotation of the shaft 9. The tongue member 8 is normally disposed on the paper sheets 4.

One end of a lever 10 is fixedly connected to one end of the shaft member 9 and the other end of the lever 10 is rotatably connected to the plunger of a solenoid 11. When the solenoid 11 is energized, the plunger is pulled in, which in turn pulls the other end of the lever 10 causing the shaft member 9 to be rotated in one direction, e.g. counterclockwise in FIGS. 2 and 3. Upon rotation of the shaft member 9, the tongue member 8 is rotated in the same direction, so that the paper sheet stack 4 is depressed downwardly and isolated from the feed rolls 1.

In the manual feeding device, a photoelectric sensor 12 is provided between the manual feeding rolls 7 and the manual feeding table 6. The photoelectric sensor 12 comprises a light source and a photosensitive element disposed perpendicularly to the paper sheet plane passing therethrough. The photoelectric sensor 12 detects the passing of a paper sheet therethrough and provides a signal for energizing the solenoid 11.

Thus, the manual paper sheet feeding device is selected and a paper sheet is fed manually to the rolls 7, and the solenoid 11 is energized to pull the plunger thereof to thereby isolate the paper sheet on the base plate 13 from the rolls 1, resulting in the automatic paper sheet feeding device being inoperative.

As mentioned hereinbefore, according to the present invention, it is not necessary to remove the cassette of the automatic paper sheet feeding device from the paper sheet feeding apparatus of the copying machine which has the manual and automatic paper sheet feeding devices when the manual feeding operation is selected.

What is claimed is:

1. A paper sheet feeding apparatus for a copying machine comprising a manual sheet feeding device having a manual feed roller and an automatic sheet feeding device having a cassette for holding a stack of paper and an automatic feed roll contacting an uppermost one of said paper sheets in said stack, support means for supporting said paper sheet stack in said cassette, bias means for urging said support means towards said automatic feed roller, a paper sheet detector in the vicinity of said manual feed roll for detecting the manual feeding of a paper sheet and providing an output signal in response to such detection and disengaging means responsive to said output signal from said detector for disengaging said automatic feed roll and said uppermost paper sheet when manually fed paper is detected, said disengaging means comprising a shaft, a lever fixedly secured to said shaft for contacting said upper sheet and means for rotating said shaft in response to said detector output signal to thereby press downwardly on said uppermost sheet to move said uppermost sheet away from said automatic feed roller against the force of said bias means.

* * * * *